US007610939B2

(12) United States Patent
Vanderjeugt et al.

(10) Patent No.: US 7,610,939 B2
(45) Date of Patent: Nov. 3, 2009

(54) JACQUARD MACHINE

(75) Inventors: Bram Vanderjeugt, Ieper (BE); Matthew Theobald, Consett (GB); James Anthony Graham, Weardale (GB)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 747 days.

(21) Appl. No.: 11/401,102

(22) Filed: Apr. 10, 2006

(65) Prior Publication Data

US 2006/0249219 A1 Nov. 9, 2006

(30) Foreign Application Priority Data

Apr. 8, 2005 (BE) ..... 2005/0185

(51) Int. Cl.
*D03C 3/24* (2006.01)
*D03C 3/32* (2006.01)
*D03C 3/00* (2006.01)

(52) U.S. Cl. ..... 139/59; 139/60; 139/61; 139/62; 139/63; 139/65

(58) Field of Classification Search ..... 139/1 R, 139/35, 59–65, 85
See application file for complete search history.

(56) References Cited

U.S. PATENT DOCUMENTS 2,083,291 A * 6/1937 Camps ..... 139/58
2,483,668 A * 10/1949 Reason et al. ..... 73/105
3,204,476 A * 9/1965 Rouverol ..... 475/159
3,210,994 A * 10/1965 Saxl ..... 73/862.471
3,323,284 A * 6/1967 Lagesse ..... 53/228
4,047,272 A * 9/1977 King et al. ..... 29/2.19
5,295,814 A * 3/1994 Uebel ..... 418/60
5,458,359 A * 10/1995 Brandt ..... 280/124.111

FOREIGN PATENT DOCUMENTS

EP 0522216 1/1993
EP 0742299 11/1996

* cited by examiner

*Primary Examiner*—Bobby H Muromoto, Jr.
(74) *Attorney, Agent, or Firm*—James Creighton Wray; Meera P. Narasimhan

(57) ABSTRACT

The invention relates to a Jacquard machine, comprising 2 sets of knifes moving up and down in opposition, which each, at each of their extremities, are taken up in separate knife grids (4*a*, 4*b*) being driven by a cinematic drive chain (30), and each, at one of their extremities (20*a*, 20*b*), being guided into a straight motion by means of a "Watt's linkage" rod system, the height of lift of each of these extremities (20*a*, 20*b*) of the knife grids (4*a*, 4*b*) being adjustable, and the knife grids (4*a*, 4*b*) each at their first extremities (20*a*, 20*b*) being linked with at least one first driving lever (2, 2*a*, 2*b*, 10) by means of a first linking rod (3*a*, 3*b*), and at their second extremities (21*a*, 21*b*) being linked with at least a second driving lever (2, 10) by means of a second linking rod (14*a*, 14*b*), wherein per knife grid (4*a*, 4*b*) one or several elements (1, 101, 1*a*, 1*b*, 3*a*, 3*b*) of the Watt's linkage rod system are part of the cinematic drive chain (30), and the amplitude of the motion of the said extremity (20*a*, 20*b*) of the knife grid (4*a*, 4*b*) is adjustable in the cinematic drive chain (30) before the linking point (9*a*, 9*b*) between the first rod (1, 101, 1*a*, 1*b*) and the third rod (3*a*, 3*b*) of the Watt's linkage rod system with respect to the drive motor.

13 Claims, 2 Drawing Sheets

JACQUARD MACHINE

This application claims the benefit of Belgian Application No. 2005/0185 filed Apr. 8, 2005.

BACKGROUND OF THE INVENTION

The invention relates to a Jacquard machine, comprising 2 sets of knifes moving up and down in opposition, which each, at their extremities, are taken up in separate knife grids being driven by a cinematic drive chain, and each, at one of their extremities, being guided into a straight motion by means of a "Watt's linkage" rod system, the height of lift of each of these extremities of the knife grids being adjustable, and the knife grids each at their first extremities being linked with at least one first driving lever by means of a first linking rod, and at their second extremities being linked with at least a second driving lever by means of a second linking rod.

The construction of Jacquard machines is subjected to an ever increasing pressure to produce machine at lower prices and operating faster, that are sufficiently strong to realize the forming of the shed required, in an accurate and reliable manner, in order to produce a fabric of the quality required. It is therefore important for the construction of Jacquard machines to build knife drives, driving two sets of knifes moving up and down in opposition, at a minimal prime cost and sufficiently strong. The two sets of knifes moving up and down in opposition on either side of the Jacquard machine are each taken up by a knife grid, such that both at the left and at the right (seen from the position of the weaver looking in the direction from where the warp yarns are supplied) there are two knife grids moving up and down in opposition in the direction of the Jacquard. When the knifes are installed in the warp direction, the terms left and right have to be interpreted as front and back, seen from the position of the weaver looking in the direction from where the warp yarns are supplied.

For a strongly operating machine it is important that the knife grids are moving in a practical vertical position, in order to cause only little vibrations, especially at high operational speeds, in order to obtain a well formed shed as well as to limit the wear and tear of the various components and to increase the machine's endurance. If, at the same time, it will be possible to obtain a reduction of the inertia of the mechanism, vibrations and wear and tear will be further reduced and the endurance will be increased.

For the building of Jacquard machines, solutions are known according to the state-of-the-art, to vertically guide the motion of the knife grids.

So it is known from EP 136 244 to guide both knife grids, practically in their central position by means of a linear guide in order to obtain a vertical motion. Both knife grids are moving one above the other and in opposition, such that it will be possible to make the two grids operate on one linear guide. Such guides, however, are strongly subject to wear. Moreover, the knife grids situated one above the other will cause the height required to install them to be great.

In EP 409 139 the knife grids are guided in their vertical motion at one extremity by a little carriage, attached by a hinge to the extremity of a knife grid, and which has been provided with rollers moving up and down in a vertical guiding slot during the up and down motion of the knife grids, such that this extremity of the knife grid performs a practically vertical motion. The other extremity of the knife grid is moving vertically up and down in a guiding slot, whereas the extremity is free to move in the direction from back to front, seen from the position of the weaver. So, this said other extremity of the knife grid is not moving only vertically, but is free to move in the warp direction of the weaving machine situated below. This way of installing is already more compact as to height than is the case in the one shown in EP 136 244, but also here, the guiding components will cause wear, thus increasing the cost for maintenance and it is no guarantee for a permanent good performance of the Jacquard machine.

In EP 488 915 the knife grids are moving in a frame that is provided with guiding slots, in which the knife grids are moving up and down. The guiding slots are a disadvantage, because there is quite some significant material contact, causing friction and developing heat and the components will be subject to wear. At high speeds, these effects are very disadvantageously increased.

In EP 0 754 791 a "Panhard Rod Guide" is used for each knife grid. With this, the knife grid is guided in its vertical motion by a rod, one of its extremities is hingedly linked up, practically in the centre of the knife grid, and, at the other extremity, is swivelling about a fixed point on the frame of the machine. Because of which the motion of this hinge point between rod and knife grid is reduced to an arch of a circle. When the rod is in a practically horizontal position, a motion following the arc is corresponding to a practically vertical motion through a limited angular displacement. However, the longer the motion of the knife grid, the greater the deviation with respect to the vertical motion. However, the longer the rod, the smaller the deviation, but the more expensive the part and the greater the inertia. For larger Jacquard machines, additional slots are provided at the left and right, having the known disadvantages as far as wear and maintenance costs are concerned.

According to the state-of-the-art, other Jacquard machines are known by the type name of BONAS MJ, a so-called "Watt's linkage" being used to vertically guide the motion of the knife grids. A "Watt's linkage" is a system of rods with three rods, the two outermost rods having the same length, i.e. a first and a second rod, at one of their extremities, hinging about fixed points, which points are not coinciding, and their other extremities, each being linked with one of the extremities of a third rod. This rod system has the property that the centre between the two linking points with the first and the second rod respectively is following a substantially linear motion on this third rod, when the first two rods are rotating about their fixed hinge points. A characteristic of this solution is that it is more wear-resistant and stronger than the said solutions.

In the Jacquard machine of the BONAS MJ type, this principle is applied by adding three rods, constituting the Watt's linkage as described before, to the mechanism in such a manner that the linear motion of the centre of the third rod will be moving vertically. The centre of this third rod is linked with the linking point of a knife grid. In such a Jacquard machine, a substantially vertical motion is imposed on the linking point of the central rod with the knife grid without any appreciable wear being caused and heat being developed. Because of this, wear remains within bounds. However, 3 additional rods and 5 additional linking points with bearings are added per knife grid, considerably increasing both the inertia and the price of the Jacquard machine.

SUMMARY OF THE INVENTION

The purpose of the invention is to provide a Jacquard machine in accordance with the preamble of the first claim, having less components and hinge points.

This purpose is attained by providing a Jacquard machine, comprising two sets of knifes moving up and down in opposition, which each, at each of their extremities, are taken up by separate knife grids being driven by a cinematic drive chain, and each, at one of their extremities, being guided into a straight motion by means of a "Watt's linkage" rod system, the height of lift of each of these extremities of the knife grids (=stroke) being adjustable, and the knife grids each at their first extremities being linked with at least one first driving lever by means of a first linking rod, and at their second extremities being linked with at least a second driving lever by means of a second linking rod, wherein per knife grid one or several elements of the Watt's linkage rod system are part of the cinematic drive chain, and the amplitude of the motion of the said extremity of the knife grid is adjustable in the cinematic drive chain before the linking point between the first rod and the third rod of the Watt's linkage rod system with respect to the drive motor.

As already mentioned above, a "Watt's linkage" is a rod system with three rods, the two outermost rods being of equal length, i.e. a first and a second rod, at one of their extremities are hinging about a non-coinciding fixed point, and with their other extremity being linked with each one of the extremities of a third rod. This rod system has the property that the centre between the two linking points with the first and the second rod respectively, is following a substantially linear motion when the first two rods are rotating about their fixed hinge point.

With a cinematic drive chain, the whole of the successive elements is meant between the drive motor (for instance of the weaving machine) and the knife grid, comprising all couplings and linking elements which are situated in between (for instance universal joints, driving boxes, cams, eccentrics, cranks, cam follower, levers and linking rods). In order to make the knife grids move up and down, the drive motor may directly supply a rocking motion or, if it supplies a continuous rotating motion, further on in the cinematic drive chain this continuous rocking motion can be transferred in a known manner into a rocking motion. When different elements of the cinematic drive chain are situated with respect to one another, the terms back and front are used for representing the order of the elements seen with respect to the drive motor (the starting point of the cinematic drive chain).

In this manner, a Jacquard machine is obtained having a reduced number of components and a restricted number of hinge points.

In an advantageous embodiment of a Jacquard machine according to the invention, one of the outermost rods of the Watt's linkage rod system is part of the cinematic drive chain.

The Watt's linkage rod system of the knife grids may be situated either both at the same extremity, or at a different extremity of the knife grids.

In a first more preferred embodiment of a Jacquard machine according to the invention, each of the knife grids, at both their extremities, are provided with linking rods for driving the knife grids of one side of the Jacquard machine to perform their up and down going motion in opposition, two driving levers being provided for driving the linking rods, the driving levers being mutually linked, and each driving lever being provided with two lever arms, carried out such that the lever arms of a same driving lever are performing an opposite motion, and each of which being linked by means of a linking rod with an extremity of one of the knife grids, two of the said linking rods being linked with one of the extremities of a different knife grid are linking a first linking point between the linking rod and the lever arm and a second linking point between the linking rod and the extremity of the respective knife grid, and which are extending further on in the prolongation of the line constituted by the two linking points through and passing a third linking point, which with respect to the second linking point is situated at the same distance as the distance between the second linking point and the first linking point, but away from the first linking point, and which is linking the linking rod with the second rod of the Watt's linkage rod system, which in its outermost position is provided with a fixed bearing and the distance between the fixed bearing and the third linking point being substantially equal to the distance between the first linking point and the hinge point about which the driving lever is rocking.

By providing such a more preferred embodiment, the said two lever arms of the driving lever, together with the second rod, constitute a Watt's linkage rod system, with the linking point of the linking rod which is linked with the extremity of the knife grid is performing an substantially linear motion. In order to realize this straight line guide, only one rod (lever) and two bearings per straight line guide are added to the cinematic drive chain. The two bearings relate to the said fixed bearing of the second rod and the bearing of the said third linking point. This is particularly advantageous to keep within limits both the cost and the inertia. Also the maintenance costs for the Jacquard machine are kept restricted, since there are less points of wear in the Jacquard machine (no sliding straight line guide and less hinge points). Because it is essential to a straight line guide with a Watt's linkage rod system, that the lever arms, each being linked with the extremities of a third rod, are of the same length, it is no longer possible to realize the adjustability of the stroke of the extremities of the knife grids in the lever arms, as it is usual according to the-state-of-the-art, because they are part of the Watt's linkage rod system. Preferably, the adjustability of the stroke occurs in a lever arm of the driving lever that is not a part of the Watt's linkage rod system. When for the two knife grids on one side of the Jacquard machine, the Watt's linkages are situated at the same extremity, this embodiment does have the consequence that adjusting the stroke for both these extremities will occur at the same time.

Since, in this more preferred embodiment, the Watt's linkages for both knife grids are coupled with the lever arms of one driving lever, and both knife grids are performing a mutually opposite motion, the two lever arms are situated substantially diametrically opposed to one another. This means that the linking points with both knife grids are situated at a certain distance from one another and for one of these knife grids, the linking point will be situated farther for the last knife on that side than will be the case for the other knife. Consequently, both knife grids are not evenly dimensioned and they have a different stiffness.

In a second more preferred embodiment of a Jacquard machine according to the invention, each of the knife grids, at both their extremities, are provided with linking rods for driving the knife grids on one side of the Jacquard machine to perform their up and down going motion in opposition, two driving levers being provided for driving the linking rods, and each driving lever being provided with two lever arms, the linking rods constituting the link between the extremities of the knife grids and the lever arms of the driving levers, the driving levers, each being provided with a third lever arm, which, by means of a linking rod, is linked with the lever arms of a third lever which is rockingly driven and which is transmitting the rocking motion to the driving levers, which in turn are driving the knife grids, two of the said linking rods which are linked with one of the extremities of a different knife grid are linking a first linking point between the linking rod and the lever arm and a second linking point between the linking rod and the extremity of the respective knife grid and are extending further on in the prolongation of the line constituted by the two linking points through and passing a third linking point which, with respect to the second linking point, is situated at the same distance as the distance between the second linking point and the first linking point but away from the first linking point, and which is linking the linking rod with the second rod of the Watt's linkage rod system, which in its outermost position is provided with a fixed bearing and the distance between the fixed bearing and the third linking point being substantially equal to the distance between the first linking point and the hinge point about which the driving lever is rocking.

Preferably, the said third lever is rockingly driven by a gearbox with a continuously rotating input side and a rocking output side.

In a more preferred embodiment of a Jacquard machine according to the invention, the amplitude of the motion of the said extremity of the knife grid is adjustable in the said third lever.

In a third, more preferred embodiment of a Jacquard machine according to the invention, each of the knife grids at their first extremity is provided with a first linking rod and at its second extremity is provided with a second linking rod, the linking rods being provided for driving the knife grids of one side of the Jacquard machine to perform their up and down going motion in opposition, and each linking rod is linking the first extremity of the knife grid with a separate first driving lever in a first lever arm and is provided with a third lever arm with which a linking rod is linked constituting the link with a lever arm of a second driving lever and which, in addition, is provided with one or several lever arms with which the second linking rod is linked, two of the said linking rods which are linked with one of the extremities of a respective knife grid linking a first linking point between the linking rod and the lever arm and a second linking point between the linking rod and the extremity of the respective knife grid, and are further extending, in the prolongation of the line constituted by both the linking points, through and passing a third linking point, which is situated, with respect to the second linking point at the same distance as the distance between the second linking point and the first linking point, but away from the first linking point, and which is linking the linking rod with the second rod of the Watt's linkage rod system, which in its outermost position is provided with a fixed bearing and the distance between the fixed bearing and the third linking point being substantially equal to the distance between the first linking point and the hinge point about which the driving lever is rocking.

Preferably, the second driving lever is provided with two first lever arms and two second lever arms.

Preferably, the hinge points about which the first driving levers are rocking, are situated here in one line on the same axis, such that the hinge points of the Watt's linkage is situated in one line on the same axis. By providing the adjustability of the stroke in the two additional lever arms of the first driving levers (not being part of the Watt's linkage), it will be possible to adjust the stroke separately for both knife grids. With this more preferred embodiment it will be possible to dimension the knife grids equally large, such that both knife grids will have the same stiffness.

In the first, second and third preferred embodiment of a Jacquard machine according to the invention, the two Watt's linkage rod systems may be coupled to two different driving levers, to the same or to a different extremity of the knife grids, allowing both knife grids to be made equal as to length, and for both knife sets to obtain a similar stiffness.

In the first and third more preferred embodiment of a Jacquard machine according to the invention, preferably the amplitude of the motion of the said extremity of the knife grid is adjustable in a lever arm of the first or second driving lever, not being a part of the Watt's linkage rod system.

In order to further clarify the properties and particulars of the present invention, a more detailed description will now follow of different embodiments of the drive of a Jacquard machine according to the invention. It will be obvious that nothing of the following description may be interpreted as being a restriction of the protection of this method and device according to the invention, demanded for in the claims.

Furthermore, some of these embodiments will be discussed in the attached figures, in which, by making use of reference numbers, reference is made to these figures in which:

DETAILED DESCRIPTION OF THE PREFERRED EMBODIMENTS

Figure 1:
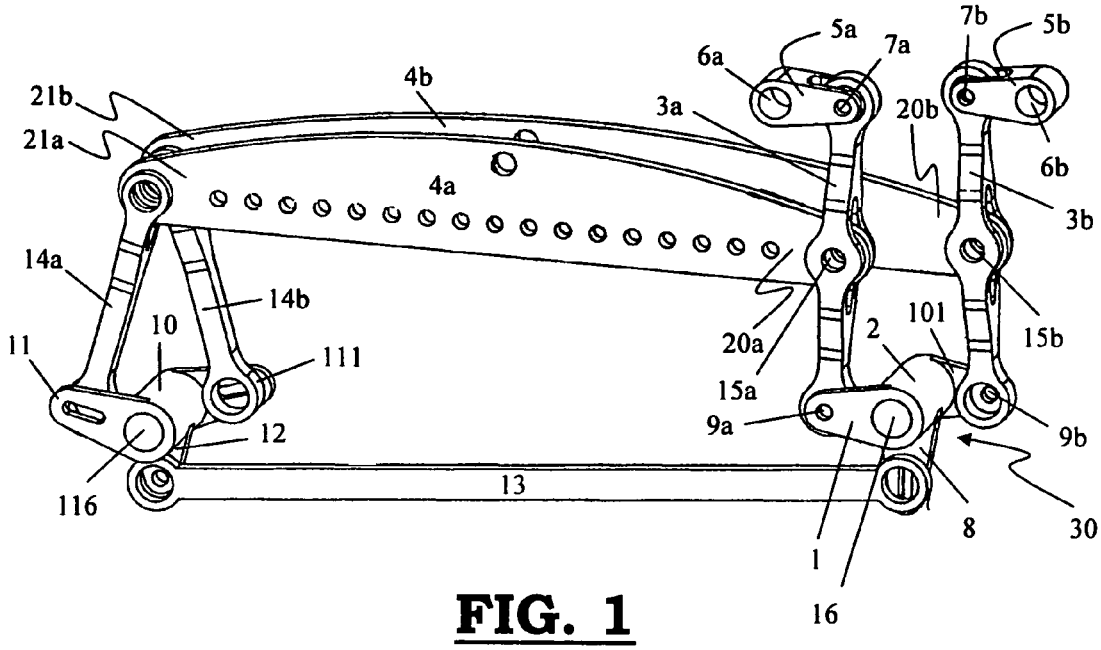
FIG. 1 is representing a first embodiment of a Jacquard machine according to the invention.

A Jacquard machine according to the invention comprises two sets of knifes moving up and down in opposition, which each, at their extremities, are taken up in separate knife grids (4*a*, 4*b*), which are driven by a cinematic drive chain (30) and which each at one of their extremities (20*a*, 20*b*) are guided into a straight motion by means of a "Watt's linkage" rod system. The height of lift of each of these extremities (20*a*, 20*b*) of the knife grids (4*a*, 4*b*) (=stroke) being adjustable. The knife grids (4*a*, 4*b*) each at their first extremities (20*a*, 20*b*), being linked with at least a first driving lever (2, 2*a*, 2*b*, 10) by means of a first linking rod (3*a*, 3*b*), and at their second extremities (21*a*, 21*b*) are linked with at least a second driving lever (2, 10) by means of a second linking rod (14*a*, 14*b*). Per knife grid (4*a*, 4*b*), one or several elements (1, 101, 1*a*, 1*b*, 3*a*, 3*b*) of the Watt's linkage rod system are part of the cinematic drive chain (30). Moreover, the amplitude of the motion of the said extremity (20*a*, 20*b*) of the knife grid (4*a*, 4*b*) is adjustable in the cinematic drive chain (30), before the linking point (9*a*, 9*b*) between the first rod (1, 101, 1*a*, 1*b*) and the third rod (3*a*, 3*b*) of the Watt's linkage rod system with respect to the drive motor.

Preferably, one of the outermost rods (1, 101, 1*a*, 1*b*) of the Watt's linkage rod system (30) is part of the cinematic drive chain.

Figure 2:
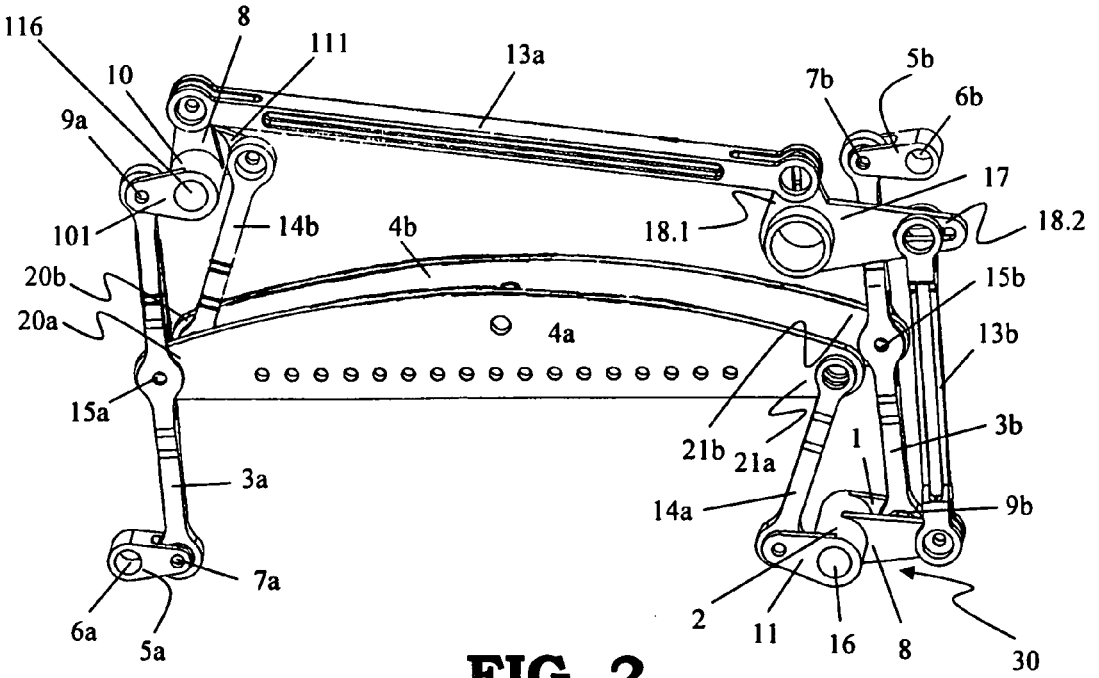
FIG. 2 is representing a second embodiment of a Jacquard machine according to the invention.

The Watt's linkage rod system of the knife grids (4*a*, 4*b*) may be situated, either at the same extremity (20*a*, 20*b*; 21*a*, 21*b*) of the knife grids (4*a*, 4*b*) (as represented in the FIGS. 1 and 3), or at a different extremity (20*a*, 21*b*; 21*a*, 20*b*) of the knife grids (4*a*, 4*b*) (as represented in FIG. 2).

In FIG. 1 a first embodiment of a Jacquard machine according to the invention is represented, in which both extremities of each of the knife grids (4*a*, 4*b*) are provided with linking rods (3*a*, 3*b*; 14*a*, 14*b*) for driving the knife grids (4*a*, 4*b*) on one side of the Jacquard machine in order to perform their motion going up and down in opposition. Moreover, the two driving levers (2, 10) are provided for driving the linking rods (3*a*, 3*b*; 14*a*, 14*b*), the driving levers (2, 10) being linked together, and each driving lever (2, 10) being provided with two lever arms (1, 101; 11, 111) having been designed such that the lever arms (1, 101; 11, 111) of a same driving lever (2, 10) will perform an opposite motion. Each of these lever arms (1, 101; 11, 111) is linked with an extremity (20*a*, 21*b*; 21*a*, 20*b*) of one of the grids (4*a*, 4*b*). Two (3*a*, 3*b*) of the said linking rods, which are linked with one of the extremities (20*a*, 20*b*) of a different knife grid (4*a*, 4*b*), have a first linking point (9*a*, 9*b*) between the linking rod (3*a*, 3*b*) and the lever arm (1, 101), and a second linking point (15*a*, 15*b*) between the linking rod (3*a*, 3*b*) and the extremity (20*a*, 20*b*) of the respective knife grid (4*a*, 4*b*) and extend further on in the prolongation of the line formed by the two linking points (9*a*, 15*a*; 9*b*, 15*b*) through the third linking point (7*a*, 7*b*), which is situated, with respect to the second linking point (15*a*, 15*b*), at the same distance as the distance between the second linking point (15*a*, 15*b*) and the first linking point (9*a*, 9*b*), but away from the first linking point (9*a*, 9*b*), and which is linking the linking rod (3*a*, 3*b*) with the second rod (5) of the Watt's linkage rod system, which in its outermost position is provided with a fixed bearing (6*a*, 6*b*) and the distance between the fixed bearing (6*a*, 6*b*) and the third linking point (7*a*, 7*b*) being substantially equal to the distance between the first linking point (9*a*, 9*b*) and the hinge point (16, 116) about which the driving lever (2, 10) is rocking.

In this way, the lever arm (1), the linking rod (3*a*) and the second rod (5*a*) on the one hand, and the lever arm (11), the linking rod (3*b*) and the second rod (5*b*) on the other hand are constituting each a Watt's linkage with the property that the linking point (15*a*, 15*b*) of the linking rod (3*a*, 3*b*) with the extremity of the respective knife grid (4*a*, 4*b*) is performing a substantially linear motion. In order to realize this straight line guide, per straight line guide only one rod (lever) (5*a*, 5*b*) and two bearings (6*a*, 6*b*; 7*a*, 7*b*) are added to the cinematic drive chain. The two bearings (6*a*, 6*b*; 7*a*, 7*b*) are relating to the said fixed bearing of the second rod and the bearing in the said third linking point.

However, since in FIG. 1 the Watt's linkage rod systems for both knife grids (4*a*, 4*b*) are linked with the lever arms (1, 11; 101, 111) of one driving lever (2, 10) and both knife grids are performing an opposite motion, both lever arms being situated substantially diametrically opposite one another, which means that the linking points (15*a*, 15*b*) with both knife grids (4*a*, 4*b*) are at a certain distance from one another and for one of these knife grids (4*a*, 4*b*) the linking point will be situated further away from the last knife on that side than will be the case for the other knife grid (4*a*, 4*b*). Both knife grids (4*a*, 4*b*) therefore, are not equally dimensioned and have a different stiffness.

Figure 3:
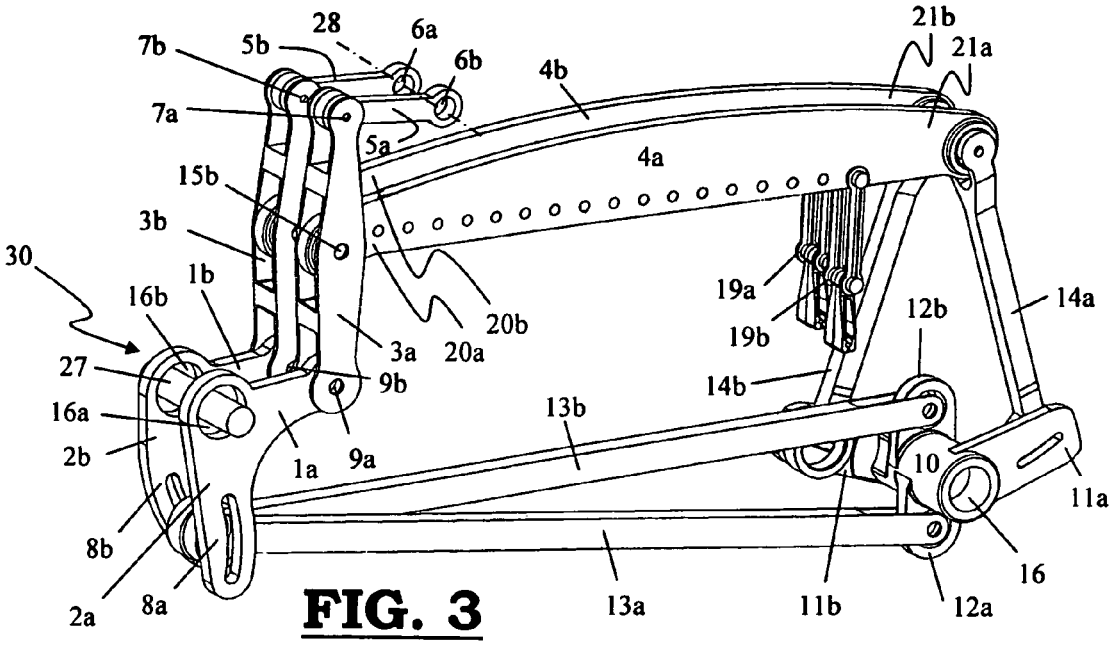
FIG. 3 is representing a third embodiment of a Jacquard machine according to the invention.

In the FIGS. 2 and 3 a solution to this problem is shown.

In FIG. 2 a second preferred embodiment of a Jacquard machine according to the invention is shown, in which each of the knife grids (4*a*, 4*b*) at both their extremities, are provided with linking rods (3*a*, 3*b*, 14*a*, 14*b*) for driving the knife grids (4*a*, 4*b*) of one side of the Jacquard machine to perform their motion going up and down in opposition, two driving levers (2, 10) being provided for driving the linking rods (3*a*, 3*b*, 14*a*, 14*b*) and each driving lever (2, 10) being provided with two lever arms (1, 101, 11, 111), the linking rods (3*a*, 3*b*, 14*a*, 14*b*) constituting the link between the extremities (20*a*, 20*b*, 21*a*, 21*b*) of the knife grids (4*a*, 4*b*) and the lever arms (1, 101, 11, 111) of the driving levers (2, 10). The driving levers (2, 10), each being provided with a third lever arm (8), which, by means of a linking rod (13*a*, 13*b*), is linked with the lever arms (18.1, 18.2) of a third lever (17) which is rockingly driven and which is transmitting the rocking motion to the driving levers (2, 10), which in turn are driving the knife grids (4*a*, 4*b*). Two (3*a*, 3*b*) of the said linking rods which are linked with one of the extremities (20*a*, 21*b*) of a different knife grid (4*a*, 4*b*) have a first linking point (9*a*, 9*b*) between the linking rod (3*a*, 3*b*) and the lever arm (1, 101) and a second linking point (15*a*, 15*b*) between the linking rod (3*a*, 3*b*) and the extremity (20*a*, 21*b*) of the respective knife grid (4*a*, 4*b*) and is extending further on in the prolongation of the line constituted by the two linking points (9*a*, 15*a*, 9*b*, 15*b*) through a third linking point (7*a*, 7*b*), which with respect to the second linking point (15*a*, 15*b*) is situated at the same distance as the distance between the second linking point (15*a*, 15*b*) and the first linking point (9*a*, 9*b*) but away from the first linking point (9*a*, 9*b*), and which is linking the linking rod (3*a*, 3*b*) with the second rod (5) of the Watt's linkage rod system, which in its outermost position is provided with a fixed bearing (6*a*, 6*b*) and the distance between the fixed bearing (6*a*, 6*b*) and the third linking point (7*a*, 7*b*) being substantially equal to the distance between the first linking point (9*a*, 9*b*) and the hinge point (16, 116) about which the driving lever (2, 10) is rocking.

Preferably, the said third lever (17) is driven rockingly by a gearbox having a continuously rotating input side and a rocking output side. Furthermore it remains possible (not represented in the figure) to carry out the link between the linking rods (14*a*, 14*b*), not being part of the Watt's linkage rod system and the arms (11, 111) of the respective driving lever (2, 10) with a slot, such that these extremities (20*b*, 21*b*) of the knife grids (4*a*, 4*b*) may be adjusted, separately from the extremities (20*a*, 21*b*) of the knife grids (4*a*, 4*b*), which are linked with the linking rods (3*a*, 3*b*) which are integrated in the Watt's linkage rod system in the cinematic drive chain (30).

In FIG. 3 a third preferred embodiment of a Jacquard machine according to the invention is shown, in which each of the knife grids (4*a*, 4*b*) at their first extremities (20*a*, 20*b*) are provided with a first linking rod (3*a*, 3*b*) and at their second extremities (21*a*, 21*b*) are provided with a second linking rod (14*a*, 14*b*), the linking rods (3*a*, 3*b*, 14*a*, 14*b*) being provided for driving the knife grids (4*a*, 4*b*) of one side of the Jacquard machine to perform their motion going up and down in opposition. Each linking rod (3*a*, 3*b*) is linking the first extremity (20*a*, 20*b*) of the knife grid (4*a*, 4*b*) with a separate first driving lever (2*a*, 2*b*) in a first lever arm (1*a*, 1*b*) and is provided with a third lever arm (8*a*, 8*b*) to which a linking rod (13*a*, 13*b*) is linked constituting the link with a lever arm (12*a*, 12*b*) of a second driving lever (10) and which, in addition, is provided with one or several lever arms (11*a*, 11*b*) with which the second linking rod (14*a*, 14*b*) is linked. Two (3*a*, 3*b*) of the said linking rods which are linked with one of the extremities (20*a*, 20*b*) of a respective knife grid (4*a*, 4*b*) having a first linking point (9*a*, 9*b*) between the linking rod (3*a*, 3*b*) and the lever arm (1*a*, 1*b*) and a second linking point (15*a*, 15*b*) between the linking rod (3*a*, 3*b*) and the extremity (20*a*, 21*b*) of the respective knife grid (4*a*, 4*b*). In the prolongation of the line formed by both the linking points (9*a*, 15*a*; 9*b*, 15*b*), the linking rod (3*a*, 3*b*) is extending further on through and passing the third linking point (7*a*, 7*b*) which, with respect to the second linking point (15*a*, 15*b*), is situated at the same distance as the distance between the second linking point (15*a*, 15*b*) and the second linking point (9*a*,9*b*), but further away from the first linking point (9*a*, 9*b*), and which is linking the linking rod (3*a*, 3*b*) with the second rod (5) of the Watt's linkage rod system. This second rod, in its outermost position, is provided with a fixed bearing (6*a*, 6*b*) and the distance between the fixed bearing (6*a*, 6*b*) and the third linking point (7*a*, 7*b*) is substantially equal to the distance between the first linking point (9*a*, 9*b*) and the hinge point (16, 116) about which the driving lever (2, 10) is rocking.

Preferably, the second driving lever (10) is provided with two first lever arms (12*a*, 12*b*) and two second lever arms (11*a*, 11*b*).

Preferably, the hinge points (16*a*, 16*b*) about which the first driving levers (2*a*, 2*b*) are rocking, are situated in one line on the same axis (27), such that the hinge points (6*a*, 6*b*) of the Watt's linkage are situated in one line on the same axis (28). This enables the fixed hinge points (6*a*,6*b*) to be installed on a fixed common shaft (28), because of which the construction is simplified with respect to the FIGS. 1 and 2.

In the FIGS. 1 and 2 the two Watt's linkage rod systems are linked with two different driving levers (2, 10; 2*a*, 2*b*) at the same or at a different extremity of the knife grids (4*a*, 4*b*), enabling both knife grids (4*a*, 4*b*) to be designed with the same length and to obtain a similar stiffness for both sets of knifes.

The adjustability of the stroke of the extremities (20*a*, 20*b*, 21*a*, 21*b*) of the knife grids (4*a*, 4*b*) does not longer occur in the lever arms (1, 11) in the three embodiments, as represented in the FIGS. 1 up to and including 3 as usual according to the state-of-the-art. According to the state-of-the-art, the stroke is adjusted by moving the linking point between the lever arm of the second driving lever for driving the motion of the knife grid and the linking rod between this second driving lever and the knife grid along the said lever arm of the said driving lever. By providing such an adjustable length of the lever arm, there is no guarantee that the lever arms of the first and the second rod of the Watt's linkage rod systems are of the same length, which is essential in order to obtain a linear motion of the centre of the third rod.

By adjusting the stroke in a place further on in the cinematic drive chain (30), i.e. closer to the drive motor, an integrated Watt's linkage rod system may be used indeed. Therefore, in the FIGS. 1 and 3, the amplitude of the motion of the said extremity (20*a*, 20*b*) of the knife grid (4*a*, 4*b*), preferably is made adjustable in a lever arm (8, 8*a*, 8*b*) of the first and the second driving lever (2, 2*a*, 2*b*, 10), which is no part of the Watt's linkage rod system. As a consequence, adjusting the lease in this embodiment according to FIG. 1 is always occurring at the same time for both extremities of the knife grids (4*a*, 4*b*), which are linked with lever (2), through the lever arms (1, 11). By providing the adjustability of the height of lift in both arms (8*a*, 8*b*) of the respective lever (2*a*, 2*b*) in the embodiment according to FIG. 3, it will be possible to adjust it separately for the extremities of both knife grids (4*a*, 4*b*). In FIG. 2, the adjustability of the stroke of the different knife grids (4*a*, 4*b*) is shifted to the third lever (17) and the extremities of both knife grids may be adjusted separately.

In the FIGS. 2 and 3 the knife grids (4*a*, 4*b*) may be equally dimensioned, such that both knife sets will have the same stiffness. In FIG. 3, two sets of knife holders (19*a*, 19*b*) are represented (one for each knife grid (4*a*, 4*b*) in which it is possible to hang a knife of the Jacquard machine (not represented in the figure).

Figure 4:
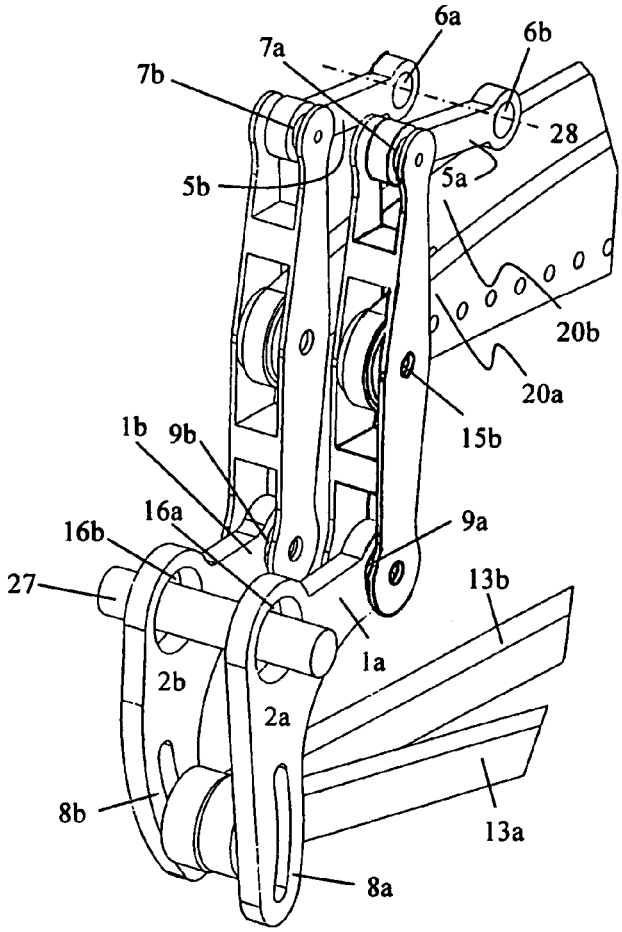
FIG. 4 is representing part of the embodiment of a Jacquard machine from FIG. 3.

In FIG. 4, part of the embodiment of FIG. 3 is represented, it being possible to realize a link with different variants of driving the other extremities (21*a*, 21*b*) of the knife grids (4*a*, 4*b*) and the rest of the cinematic drive chain (30).

The Jacquard machine according to the invention is used in combination with weaving machines which may be both single and face-to face weaving machines.

The invention claimed is:

1. Jacquard machine, comprising 2 sets of knifes moving up and down in opposition, which each, at each of their extremities, are taken up in separate knife grids being driven by a cinematic drive chain, and each, at one of their extremities, being guided into a straight motion by means of a "Watt's linkage" rod system, the height of lift of each of these extremities of the knife grids being adjustable, and the knife grids each at their first extremities being linked with at least one first driving lever by means of a first linking rod, and at their second extremities being linked with at least a second driving lever by means of a second linking rod, characterized in that per knife grid one or several elements of the Watt's linkage rod system are part of the cinematic drive chain, and the amplitude of the motion of the said extremity of the knife grid is adjustable in the cinematic drive chain before the linking point between the first rod and the third rod of the Watt's linkage rod system with respect to the drive motor.

2. Jacquard machine according to claim 1, characterized in that one of the outermost rods of the Watt's linkage rod system is part of the cinematic drive chain.

3. Jacquard machine according to claim 1, characterized in that the Watt's linkage rod systems of the knife grids are situated at the same extremity of the knife grids.

4. Jacquard machine according to claim 1, characterized in that the Watt's linkage rod systems of the knife grids are situated at a different extremity of the knife grids.

5. Jacquard machine according to claim 3, characterized in that each of the knife grids, at both their extremities, are provided with linking rods for driving the knife grids of one side of the Jacquard machine to perform their up and down going motion in opposition, two driving levers being provided for driving the linking rods, the driving levers being mutually linked, and each driving lever being provided with two lever arms, carried out such that the lever arms of a same driving lever are performing an opposite motion, and each of which being linked by means of a linking rod with an extremity of one of the knife grids, two of the said linking rods being linked with one of the extremities of a different knife grid are linking a first linking point between the linking rod and the lever arm and a second linking point between the linking rod and the extremity of the respective knife grid, and which are extending further on in the prolongation of the line constituted by the two linking points through and passing a third linking point, which with respect to the second linking point is situated at the same distance as the distance between the second linking point and the first linking point, but away from the first linking point, and which is linking the linking rod with the second rod of the Watt's linkage rod system, which in its outermost position is provided with a fixed bearing and the distance between the fixed bearing and the third linking point being substantially equal to the distance between the first linking point and the hinge point about which the driving lever is rocking.

6. Jacquard machine according to claim 3, characterized in that each of the knife grids, at both their extremities, are provided with linking rods for driving the knife grids on one side of the Jacquard machine to perform their up and down going motion in opposition, two driving levers being provided for driving the linking rods, and each driving lever being provided with two lever arms, the linking rods constituting the link between the extremities of the knife grids and the lever arms of the driving levers, the driving levers, each being provided with a third lever arm, which, by means of a linking rod, is linked with the lever arms of a third lever which is rockingly driven and which is transmitting the rocking motion to the driving levers, which in turn are driving the knife grids, two of the said linking rods which are linked with one of the extremities of a different knife grid are linking a first linking point between the linking rod and the lever arm and a second linking point between the linking rod and the extremity of the respective knife grid and are extending further on in the prolongation of the line constituted by the two linking points through and passing a third linking point which, with respect to the second linking point , is situated at the same distance as the distance between the second linking point and the first linking point but away from the first linking point, and which is linking the linking rod with the second rod of the Watt's linkage rod system, which in its outermost position is provided with a fixed bearing and the distance between the fixed bearing and the third linking point being substantially equal to the distance between the first linking point and the hinge point about which the driving lever is rocking.

7. Jacquard machine according to claim 6, characterized in that the said third lever is rockingly driven by a gearbox having a continuously rotating input side and a rocking output side.

8. Jacquard machine according to claim 6, characterized in that the amplitude of the motion of the said extremity of the knife grid is adjustable in the said third lever.

9. Jacquard machine according to claim 4, characterized in that each of the knife grids at their first extremity is provided with a first linking rod and at its second extremity is provided with a second linking rod, the linking rods being provided for driving the knife grids of one side of the Jacquard machine to perform their up and down going motion in opposition, and each linking rod is linking the first extremity of the knife grid with a separate first driving lever in a first lever arm and is provided with a third lever arm with which a linking rod is linked constituting the link with a lever arm of a second driving lever and which, in addition, is provided with one or several lever arms with which the second linking rod is linked, two of the said linking rods which are linked with one of the extremities of a respective knife grid linking a first linking point between the linking rod and the lever arm and a second linking point between the linking rod and the extremity of the respective knife grid, and are further extending, in the prolongation of the line constituted by both the linking points, through and passing a third linking point, which is situated, with respect to the second linking point at the same distance as the distance between the second linking point and the first linking point, but away from the first linking point, and which is linking the linking rod with the second rod of the Watt's linkage rod system, which in its outermost position is provided with a fixed bearing and the distance between the fixed bearing and the third linking point being substantially equal to the distance between the first linking point and the hinge point about which the driving lever is rocking.

10. Jacquard machine according to claim 9, characterized in that the second driving lever is provided with two first lever arms and two second lever arms.

11. Jacquard machine according to claim 9, characterized in that the hinge points about which the first driving levers are rocking, are situated in one line on the same axis, such that the hinge points of the Watt's linkages are situated in one line on the same axis.

12. Jacquard machine according to claim 4, characterized in that the Watt's linkage rod systems are linked with two different driving levers.

13. Jacquard machine according to claim 4, characterized in that the amplitude of the motion of the said extremity of the knife grid is adjustable in a lever arm of the first or the second driving lever which is no part of the Watt's linkage rod system.

* * * * *